US009033469B2

(12) United States Patent
Gardner et al.

(10) Patent No.: US 9,033,469 B2
(45) Date of Patent: May 19, 2015

(54) FIRING ACTUATOR POWER SUPPLY SYSTEM

(75) Inventors: James M. Gardner, Corvallis, OR (US); Peter J. Fricke, Corvallis, OR (US); Mark A. Hunter, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/345,658

(22) PCT Filed: Oct. 14, 2011

(86) PCT No.: PCT/US2011/056315

§ 371 (c)(1),
(2), (4) Date: Mar. 19, 2014

(87) PCT Pub. No.: WO2013/055356

PCT Pub. Date: Apr. 18, 2013

(65) Prior Publication Data

US 2014/0232791 A1 Aug. 21, 2014

(51) Int. Cl.
*B41J 2/15* (2006.01)
*B41J 2/045* (2006.01)

(52) U.S. Cl.
CPC ..... *B41J 2/0455* (2013.01); *B41J 2/04541* (2013.01); *B41J 2/04548* (2013.01); *B41J 2/0458* (2013.01); *B41J 2/04581* (2013.01)

(58) Field of Classification Search
CPC ..... B41J 2/14129; B41J 2/04588; B41J 2/04555; B41J 2/1648; B41J 2/04541
See application file for complete search history.

(56) References Cited

U.S. PATENT DOCUMENTS

| | | | | |
|---|---|---|---|---|
| 6,331,052 | B1 * | 12/2001 | Murai et al. | 347/68 |
| 7,104,624 | B2 | 9/2006 | Schloeman et al. | |
| 7,390,071 | B2 * | 6/2008 | Walmsley et al. | 347/13 |
| 7,401,906 | B2 | 7/2008 | Hawkins et al. | |
| 7,549,715 | B2 * | 6/2009 | Walmsley et al. | 347/9 |
| 7,604,312 | B2 | 10/2009 | Wade | |
| 7,938,501 | B2 | 5/2011 | Takamiya et al. | |
| 2002/0130912 | A1 | 9/2002 | Beck et al. | |
| 2004/0125157 | A1 | 7/2004 | Edelen et al. | |
| 2006/0262156 | A1 | 11/2006 | Liao et al. | |
| 2007/0195135 | A1 | 8/2007 | Kim et al. | |
| 2007/0216715 | A1 | 9/2007 | Zhao et al. | |
| 2010/0188456 | A1 | 7/2010 | Gadke et al. | |

FOREIGN PATENT DOCUMENTS

| | | |
|---|---|---|
| EP | 1103380 | 5/2001 |
| KR | 20100069210 | 6/2010 |

* cited by examiner

*Primary Examiner* — Lamson Nguyen
(74) *Attorney, Agent, or Firm* — Rathe Lindenbaum LLP

(57) ABSTRACT

A method and apparatus supply electrical current to a firing actuator of a printhead die across a high side switching transistor in a source follower arrangement and supply a regulated voltage, that is no greater than a concurrent voltage at a drain of the HSS transistor, to a gate of the high side switching transistor.

13 Claims, 5 Drawing Sheets

FIRING ACTUATOR POWER SUPPLY SYSTEM

BACKGROUND

Inkjet printers may utilize firing actuators, such as resistor actuators or piezo actuators, on a printhead to selectively eject printing fluid. Delivery of electrical power to the firing actuators sometimes results in parasitic voltage losses which leads to significant variations in the voltage delivered at the firing actuators which may cause unreliable drop ejection. Although the application of over energy to the firing actuators may address such variations in the voltage delivered at the firing actuators, over energy may reduce printer reliability, may create performance limitations and may reduce printer design flexibility.

DETAILED DESCRIPTION OF THE EXAMPLE EMBODIMENTS

Figure 1:
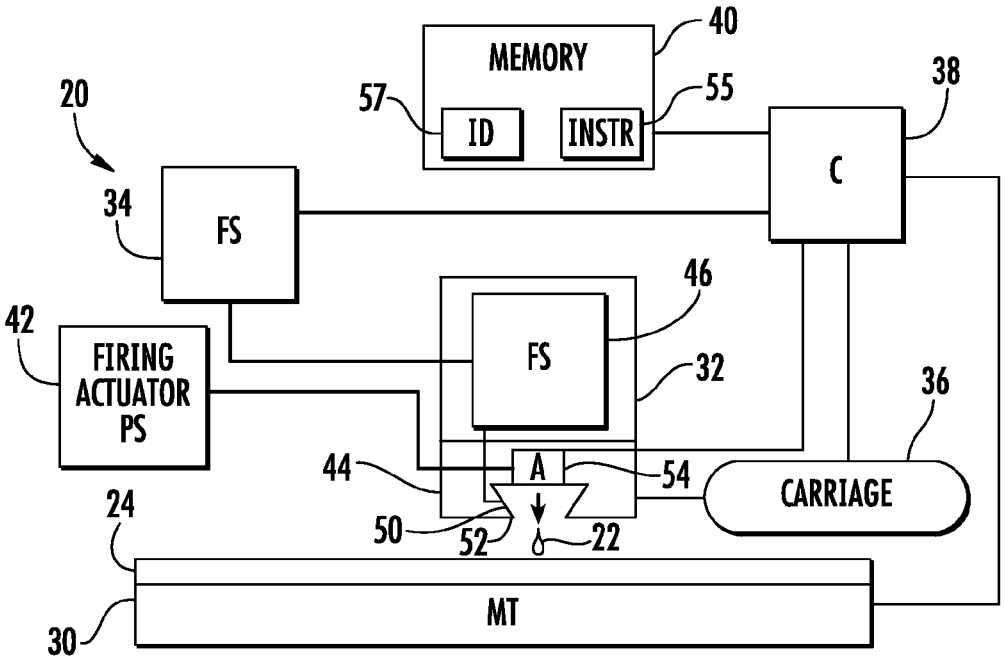
FIG. 1 is a schematic illustration of an example printing system including an inkjet firing actuator power supply system.

FIG. 1 schematically illustrates an example printing system 20. Printing system 20 is configured to selectively deliver drops 22 of fluid or liquid onto a print media 24. Printing system 20 utilizes drop-on-demand inkjet technology. As will be described hereafter, printing system 20 comprises an inkjet firing actuator power supply system 60 (shown in FIG. 2) that supplies electrical power to the inkjet firing actuators with less voltage variations for enhanced printer reliability, performance and design flexibility.

Printing system 20 comprises media transport 30, printhead assembly or printing unit 32, fluid supply 34, carriage 36, controller 38, memory 40 and inkjet firing actuator power supply system 42. Media transport 30 comprises a mechanism configured to transport or move print media 24 relative to print unit 32. In one example, print media 24 may comprise a web. In another example, print media 24 may comprise individual sheets. In one example to print media 24 may comprise a cellulose-based material, such as paper. In another example print media 24 may comprise other materials upon which ink or other liquids are deposited. In one example, media transport 30 may comprise a series of rollers and a platen configured to support media 24 as the liquid is deposited upon the print media 24. In another example, media transport 30 may comprise a drum upon which media 24 is supported as the liquid is deposited upon medium 24.

Print unit 32 ejects droplets 22 onto a media 24. Although one unit 32 is illustrated for ease of illustration, printing system 20 may include a multitude of print units 32. Each print unit 32 comprises printhead 44 and fluid supply 46. Printhead 44 comprises one or more chambers 50, one or more nozzles 52 and an inkjet firing actuator 54. Each chamber 50 comprises a volume of fluid connected to supply 46 to receive fluid from supply 46. Each chamber 50 is located between and associated with one or more nozzles 52 and actuator 54. The one or more nozzles 52 each comprise small openings through which fluid or liquid is ejected onto print media 24.

Actuator 54 comprises a firing actuator opposite to chamber 50 which causes ink or other liquid to be forcefully ejected or expelled in response to electrical current passing across the actuator 54. Each chamber 50 of printhead 44 has a dedicated actuator 54. Each actuator 54 is connected to electrodes provided by electrically conductive traces. The supply of electrical power to the electrically conductive traces and to each resistor is provided by firing inkjet resistor power supply system 60 (shown in FIG. 2), wherein individual actuators 54 associated with individual nozzles 52 are selectively fired in response to control signals from controller 38. In one example, controller 38 actuates one or more switches, such as thin-film transistors, to selectively control the transmission of electrical power across each actuator 54.

In the example illustrated, actuator 54 comprises a thermal inkjet (TIJ) firing resistor. The transmission of electrical power across actuator 54 heats actuator 54 to a sufficiently high temperature such that actuator 54 vaporizes fluid within chamber 50, creating a rapidly expanding vapor bubble that forces droplet 22 out of nozzle 52. In another example, actuator 54 may comprise a piezocapacitive firing actuator, wherein the application of a voltage across the piezo actuator results in a flexible membrane changing shape or flexing to forcibly expel the ink or liquid through nozzle 52. As will be described hereafter, inkjet firing actuator power supply system 60 supplies power to each of actuators 54 (one of which is shown) with less voltage variation, addressing the voltage variations that otherwise occur as a result of parasitic voltage losses.

Fluid supply 46 comprises an on-board volume, container or reservoir containing fluid in close proximity with printhead 44. Fluid supply 34 comprises a remote or off axis volume, container or reservoir of fluid which is applied to fluid supply 46 through one or more fluid conduits. In some examples, fluid supply 34 may be omitted, wherein entire supply of liquid or fluid for printhead 44 is provided by fluid reservoir 46. For example, in some examples, print unit 32 may comprise a print cartridge which is replaceable or refillable when fluid from supply 46 has been exhausted.

Carriage 36 comprise a mechanism configured to linearly translate or scan print unit 32 relative to print medium 24 and media transport 30. In some examples where print unit 32 spans media transport 30 and media 24, such as with a page wide array printer, carriage 36 may be omitted.

Controller 38 comprises one or more processing units configured to generate control signals directing the operation of media transport 30, fluid supply 34, carriage 36 and actuator 54 of printhead 44. For purposes of this application, the term "processing unit" shall mean a presently developed or future developed processing unit that executes sequences of instructions contained in memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other examples, hard wired circuitry may be used in place of or in combination with software instructions to implement the functions described. For example, controller 38 may be embodied as part of one or more application-specific integrated circuits (ASICs). Unless otherwise specifically noted, the controller is not limited to any specific combination of hardware circuitry and software, nor to any particular source for the instructions executed by the processing unit.

In the example illustrated, controller 38 carries out or follows instructions 55 contained in memory 40. In operation, controller 38 generates control signals to fluid supply 34 to ensure that fluid supply 46 has sufficient fluid for printing. In those examples in which fluid supply 34 is omitted, such control steps are also omitted. To effectuate printing based upon image data 57 at least temporarily stored in memory 40, controller 38 generates control signals directing media transport 30 to position media 24 relative to print unit 32. Controller 38 also generates control signals causing carriage 36 to scan print unit 32 back and forth across print media 24. In those examples in which print unit 32 sufficiently spans media 24 (such as with a page wide array), control of carriage 36 by controller 38 may be omitted. To deposit fluid onto medium 24, controller 38 generates control signals selectively heating actuator 54 opposite to selected nozzles 52 to eject or fire liquid onto media 24 to form the image according to image data 57.

Figure 2:
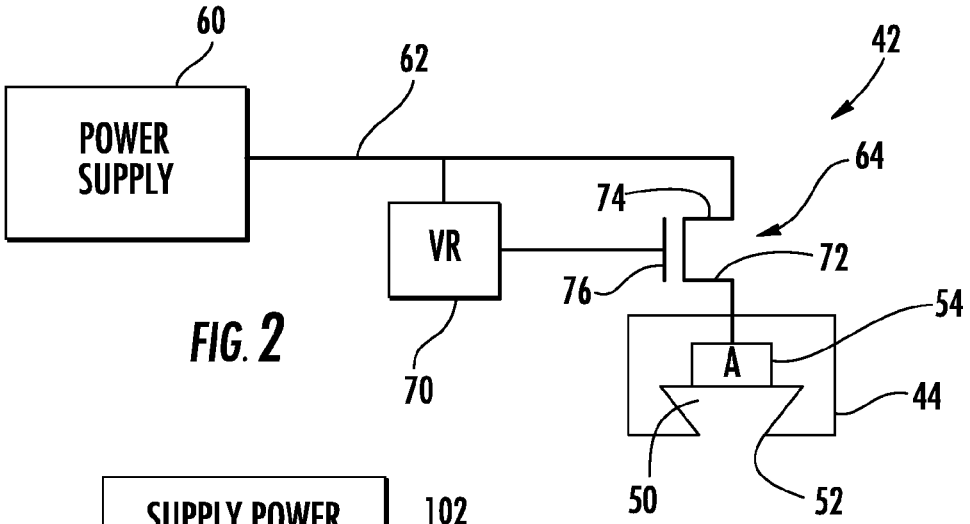
FIG. 2 is a schematic illustration of the inkjet firing actuator power supply system of FIG. 1.

FIG. 2 schematically illustrates firing inkjet power supply system 42 in more detail. Firing inkjet power supply system 60 supplies electrical power to each actuator 54 of printhead die 44. As noted above, the supply of electric power to each actuator 54 is selectively controlled in response to control signals from controller 38 (shown FIG. 1) by one or more switches or transistors (not shown in FIG. 2). Inkjet firing actuator power supply system 60 supplies power to each of actuators 54 (one of which is shown) with less voltage variation, addressing the voltage variations that otherwise occur as a result of parasitic voltage losses. System 60 comprises power supply 60, internal power supply path 62, high side switching transistor 64 and voltage regulator 70.

Power supply 60 comprises a source of electrical power for actuator 54. Power supply 60 may additionally supply power other components of printing system 20. Internal power supply path 62 comprises electrically conductive wiring, traces or the like for electrically conducting or transmitting electrical power from power supply 60 to actuator 54. Internal power supply path 62 may extend along a cable, a printed circuit board, a flexible cable and/or integrated circuit power traces as it routes electrical power from power supply 60 to actuator 54. During such transmission, internal power supply path 62, as well as other structures, may introduce parasitic voltage losses. As noted above, such parasitic voltage losses may cause voltage variations along internal power supply path 62.

High side switching (HSS) transistor 64 comprises transistor in a source follower arrangement. In particular, as shown by FIG. 2, transistor 64 has a source 72 electrically connected to actuator 54, a drain 74 electrically connected to internal power supply path 62 and a gate 76 electrically connected to voltage regulator 70. In other words, source 72 is in closer electrical proximity to actuator 54 or drain 74 is in closer electrical proximity to path 62. In a "source follower arrangement", the voltage seen at source 72 follows the voltage at gate 76.

According to one example, transistor 64 comprises a power field effect transistor, such as a MOSFET transistor. According to one example, transistor 64 comprises a LDMOS transistor. In other examples, transistor 64 may comprise other forms of transistors which similarly selectively transmit a voltage to actuator 54 which follows the voltage presented at gate 76.

Voltage regulator 70 comprises an electrical circuit or other electrical voltage regulation device configured or constructed to provide gate 76 of transistor 64 with a controlled voltage that is no greater than a concurrent voltage at drain 74. As a result, transistor 64 absorbs voltage fluctuations on the main power system rail including voltage fluctuations of path 62. As a result, transistor 64 and voltage regulator 70 cooperate to deliver constant energy to the one or more actuators 54. By delivering a more stable or uniform voltage to the inkjet firing actuators 54, power supply 60 provides more uniform firing energy and reduces any over energy range seen at actuator 54 to increase reliability and performance.

Moreover, in printing systems where motors and other various mechanical systems utilize a voltage different than the desired inkjet resistor firing voltage, the cooperation of voltage regulator 70 and transistor 64 also allows the resistor firing voltage to be isolated from those voltages of the printing system 20 that are used to drive such motors and mechanical systems of printing system 20. With a predictable stable voltage at each actuator 54 across all load conditions, printers may utilize appropriate energetic settings that increase nozzle life and performance. By isolating the resistor firing voltage from those voltages that drive other printing system components, power supply 60 facilitates use of a mechanical system voltage different from a target resistor firing voltage, enhancing printer design flexibility.

In the example illustrated, voltage regulator 70 provides a controlled voltage that is less than a minimum system power supply voltage under maximum load. In the example illustrated, voltage regulator 70 provides a separate regulated voltage that is a several volts lower than the voltage of a main power supply, power supply 60. In other examples, voltage regulator 70 may provide other voltages to gate 76. In the example illustrated, voltage regulator 70 is implemented as part of the printhead assembly at print unit 32. In other examples, both voltage regulator may be implemented directly on printhead 44 or at other locations.

Figure 3:
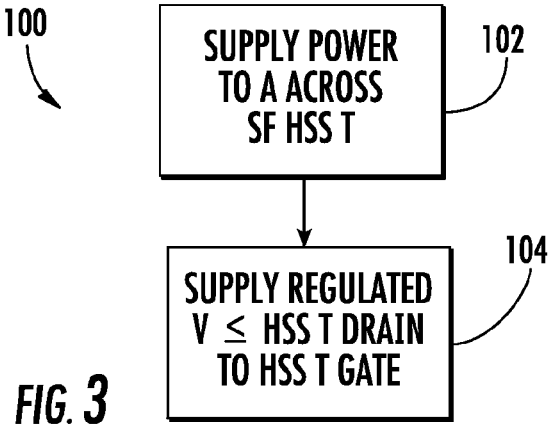
FIG. 3 is a flow diagram of an example method for supplying power to an inkjet firing actuator.

FIG. 3 is a flow diagram illustrating a process or method 100 utilized by printing system 20 (shown in FIG. 1) to deliver electrical power to the one or more actuators 54. As indicated by step 102, power is supplied to actuator 54 across a HSS transistor in a source follower (SF) arrangement. In the example shown in FIG. 2, power is supplied to actuator 54, across transistor 64 in a source follower arrangement. As indicated by step 104, a controlled or regulated voltage is further supplied to the high side switching transistor gate, wherein the controlled or regulated voltage is no greater than the concurrent voltage experience that the high side switching transistor drain. In the example shown in FIG. 2, voltage regular 70 supplied the controller regulated voltage to gate 76 of transistor 64, wherein the regulator controlled voltages no greater than the concurrent voltage seen that drain 74 of transistor 64.

Figure 4:
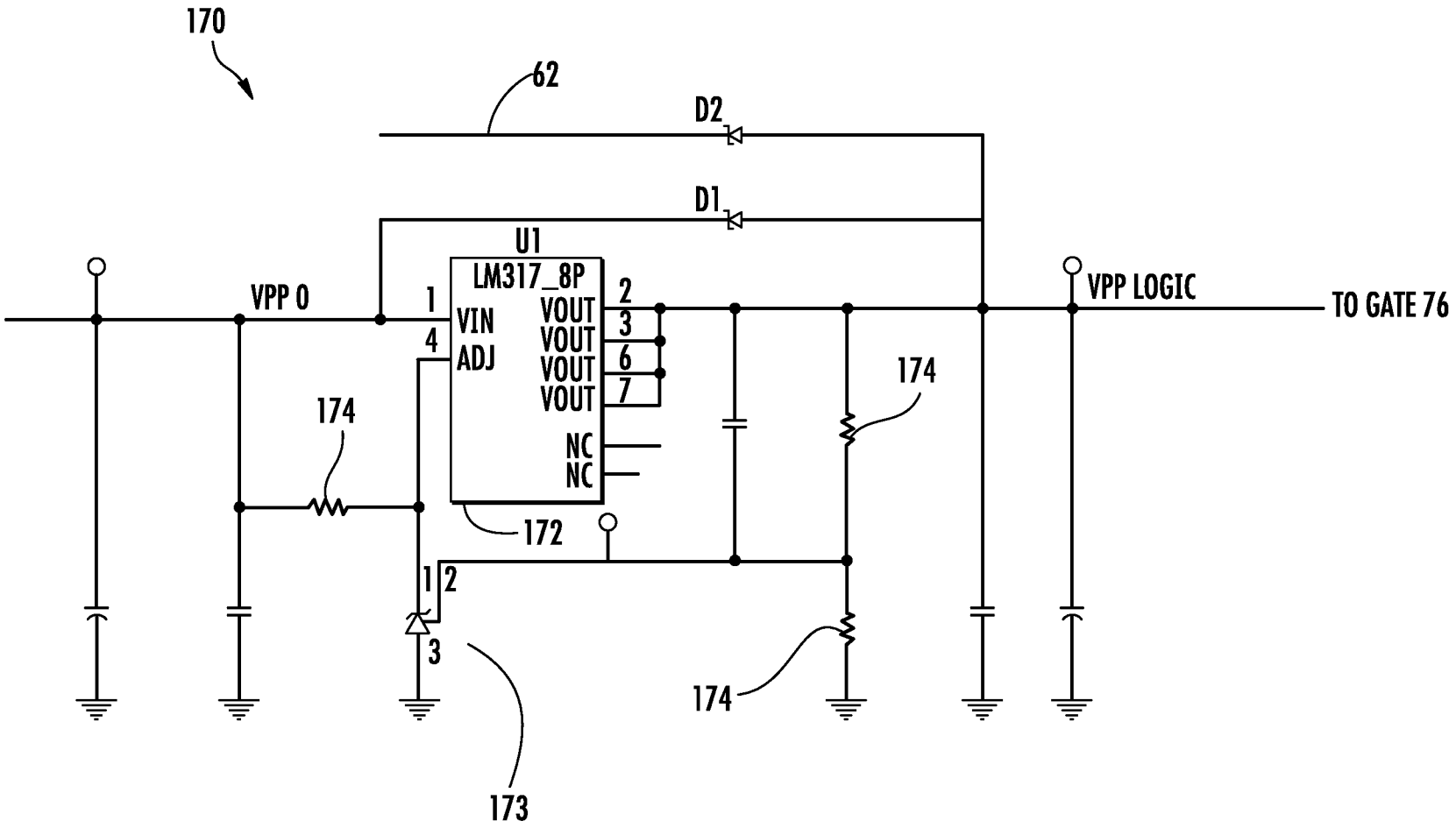
FIG. 4 is a circuit diagram of an example voltage regulator of the inkjet firing actuator power supply system of FIG. 2.

FIG. 4 is a circuit diagram of voltage regulator 170, one example of voltage regulator 70 that may be employed in firing inkjet resistor power supply system 42. Like voltage regulator 70, voltage regulator 170 comprises an electrical circuit to provide gate 76 of transistor 64 (shown in FIG. 2) with a controlled voltage that is no greater than a concurrent voltage at drain 74. Voltage regulator 170 comprises linear regulator 172, shunt regulator 173 and feedback resistors 174. Feedback resistors 174 are connected to linear regular 172 and cooperate with linear regulator 172 and shunt regulator 173 such that the output voltage of regular 172 which is provided to gate 76 (shown in FIG. 2) is less than a minimum system supply voltage under maximum load. In the example illustrated, linear regulator 172 comprises a LM317 regulator commercially available from Texas Instruments. Shunt regulator 173 comprises a TL431 shunt regulator partially available from Texas Instruments. In other examples, voltage regulator 170 may have other configurations different than that shown in FIG. 4.

Figure 5:
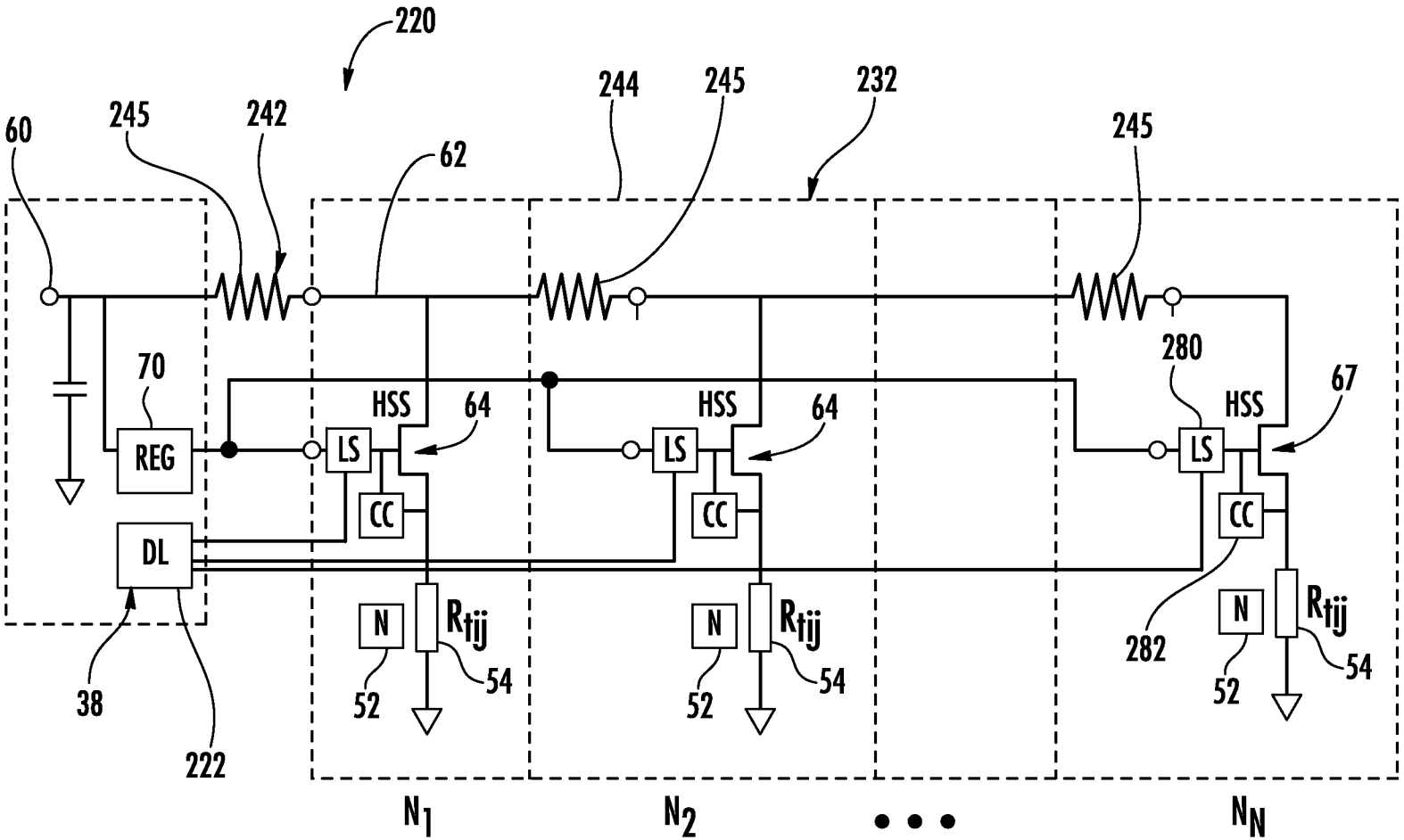
FIG. 5 is a circuit diagram of another example of the printing system of FIG. 1 including another example of an inkjet firing actuator power supply system.

FIG. 5 schematically illustrates printing system 220, an example of printing system 20. Printing system 220 comprises media transport 30 (shown in FIG. 1), printhead assembly or printing unit 232, fluid supply 34 (shown in FIG. 1), carriage 36 (shown in FIG. 1), controller 38 including digital logic 222, memory 40 (shown in FIG. 1) and firing inkjet resistor power supply system 242. Print unit 232 is similar to print unit 32 (shown and described with respect to FIG. 1) in that print unit 232 includes fluid supply 46 (shown in FIG. 1) and a printhead die 244. As shown by FIG. 5, printhead die 244 comprises a multitude of nozzles 52 ($N_1$-$N_N$) (schematically shown) and associated firing actuators 54, which are specifically illustrated as firing resistors R. Each of firing actuators 54 receives electrical power from firing inkjet resistor power supply system 242.

Firing inkjet resistor power supply system 242 is similar to system 42. Resistor power supply system 242 supplies electrical power to each of actuators 54 with less variance in spite of the resistances 245 (functionally represented by resistor symbology) along internal power supply path 62 which may introduce parasitic voltage losses. Resistor power supply system 242 comprises power supply 60, an internal power supply path 62, high side switching (HSS) transistors 64, voltage regulator 70, level shifters 280 and clamp circuits 282. Power supply 60, path 62, transistor 64 and voltage regular 70 are each described above respect to FIG. 2.

Level shifters 280 are provided on die 244 and serve as voltage translation mechanisms by which low voltage digital logic 222 of controller 38 selectively applies a higher gate voltage to gate 76 of a transistor 64 to selectively fire the associated actuator 54 and associated nozzle 52. In particular, in response to receiving a low voltage digital signal from digital logic 222, a level shifter 280 supplies gate 64 (and clamp circuit 282) with higher controlled or regulated voltage ($VPP_{logic}$) established by regulator 70. Because transistor 64 is in a source follower arrangement, the voltage seen at actuator 54 corresponds to the regulator controlled $VPP_{logic}$ provided at gate 64 in response to actuation or switching of level shifter 280.

Clamp circuits 282 are provided on die 244 for each HSS transistor 64. Each clamp circuit 282 comprises diode connected devices which turn on in response to the gate-to-source voltage becoming too high as the source voltage pulls up to match the gate voltage (the voltage at gate 76) (minus some diode voltage drops). In other examples, clamp circuits 282 may have other configurations or may be omitted.

Figure 6:
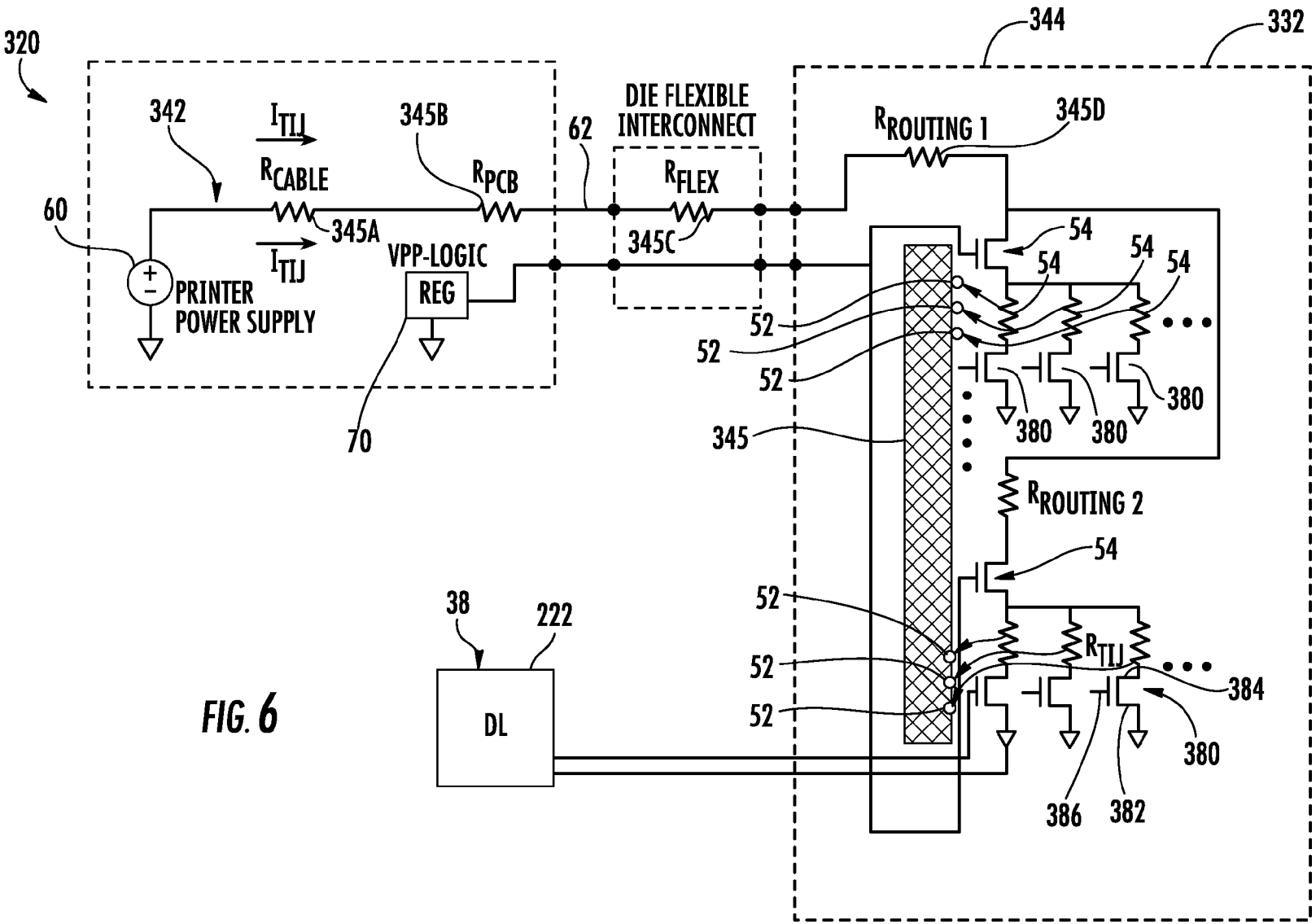
FIG. 6 is a circuit diagram of another example of the printing system of FIG. 1 including another example of an inkjet firing actuator power supply system.

As shown by FIG. 5, each firing actuator 54 on die 244 has a dedicated HSS transistor 64, a dedicated level shifter 280 and a dedicated clamp circuit 282. FIG. 6 is a circuit diagram illustrating printing system 320, another example of printing system 20. Unlike printing system 220 which employs what is sometimes referred to as a full HSS system, printing system 320 employs what is referred to as a hybrid HSS system. The hybrid HSS system of printing system 320 conserves valuable die space by facilitating the use of a single HSS transistor for multiple firing actuators 54 and nozzles 22.

FIG. 6 schematically illustrates printing system 320, another example of printing system 20. Printing system 320 comprises media transport 30 (shown in FIG. 1), printhead assembly or printing unit 332, fluid supply 34 (shown in FIG. 1), carriage 36 (shown in FIG. 1), controller 38 including digital logic 222, memory 40 (shown in FIG. 1) and firing inkjet resistor power supply system 342. Print unit or printhead assembly 332 is similar to print unit 32 (shown and described with respect to FIG. 1) in that print unit 232 includes fluid supply 46 (shown in FIG. 1) and a printhead die 344. As shown by FIG. 6, printhead die 344 comprises a multitude of nozzles 22 (schematically shown) and associated firing actuators 54 (shown as firing resistors) arranged along an ink slot 345 supplies ink or other liquid to actuators 54 and nozzles 22. Each of firing actuators 54 receives electrical power from inkjet resistor power supply system 342.

Firing inkjet resistor power supply system 342 is similar to system 42. Resistor power supply system 342 supplies electrical power to each of actuators 54 with less variance in spite of the resistances 345A, 345B, 345C and 345D along internal power supply path 62 which may introduce parasitic voltage losses. In particular, resistor 345A represents the resistance through a cable to the printed circuit board. Resistor 345B represents resistance of the path 62 on the printed circuit board. Resistor 345C represents resistance a path 62 on a flexible circuit connecting the printed circuit board to the die 344. Resistor 345D represents electrical resistance of the routing (traces) on die 344 from the flexible circuit to transistors 64. The electrical resistance of the routing or traces on die 344 may vary depending upon the location of the particular nozzle 52 and associated actuator 54. For example, an actuator 54 located near the middle of a printing slot 345 may experience higher parasitic voltage drops than an actuator 54 located near the ends of slot 345. Such printhead or die induced variations may worsen as the printheads become smaller and include fewer layers of metal to route power.

Inkjet firing actuator power supply system 342 comprises power supply 60, internal power supply path 62, high side switching (HSS) transistors 64, voltage regulator 70 and low side switching (LSS) transistors 380. Power supply 60, path 62, transistors 64 and voltage regular 70 are each described above respect to FIG. 2. LSS transistors 380 each comprise a power field effect transistor, such as a LDMOS transistor, having a source 382 connected to ground, a drain 384 electrically connected to an end of actuator 54 and a gate 386 electrically connected to nozzle drive logic and circuitry, digital logic 222. For ease of illustration, FIG. 6 merely illustrates a few of the electrical connections between digital logic 222 and a few of gates 386 of a few LSS transistors 380.

As shown by FIG. 6, each nozzle 52 and associated actuator 54 has a dedicated LSS transistor 380. Each LSS transistor 380 serves as a switching mechanism to selectively fire its associated actuator 54 and nozzle 52 in response to control signals from digital logic 222. Because inkjet firing actuator power supply system 342 includes LSS transistors 380 for selectively actuating individual actuators 54, illustrated as firing resistors, and nozzles 22, the HSS transistor 54 may be shared amongst multiple nozzles 22 and actuators 54. According to one example, a single HSS transistor is shared amongst up to 12 nozzles 22 and actuators 54 (the set of nozzles 22 and firing actuators 54 for sharing an HSS transistor sometimes referred to as a primary). Because LSS transistors 380 may be less space consuming and less expensive as compared to HSS transistors 54, cost and die space consumption are reduced.

Figure 7:
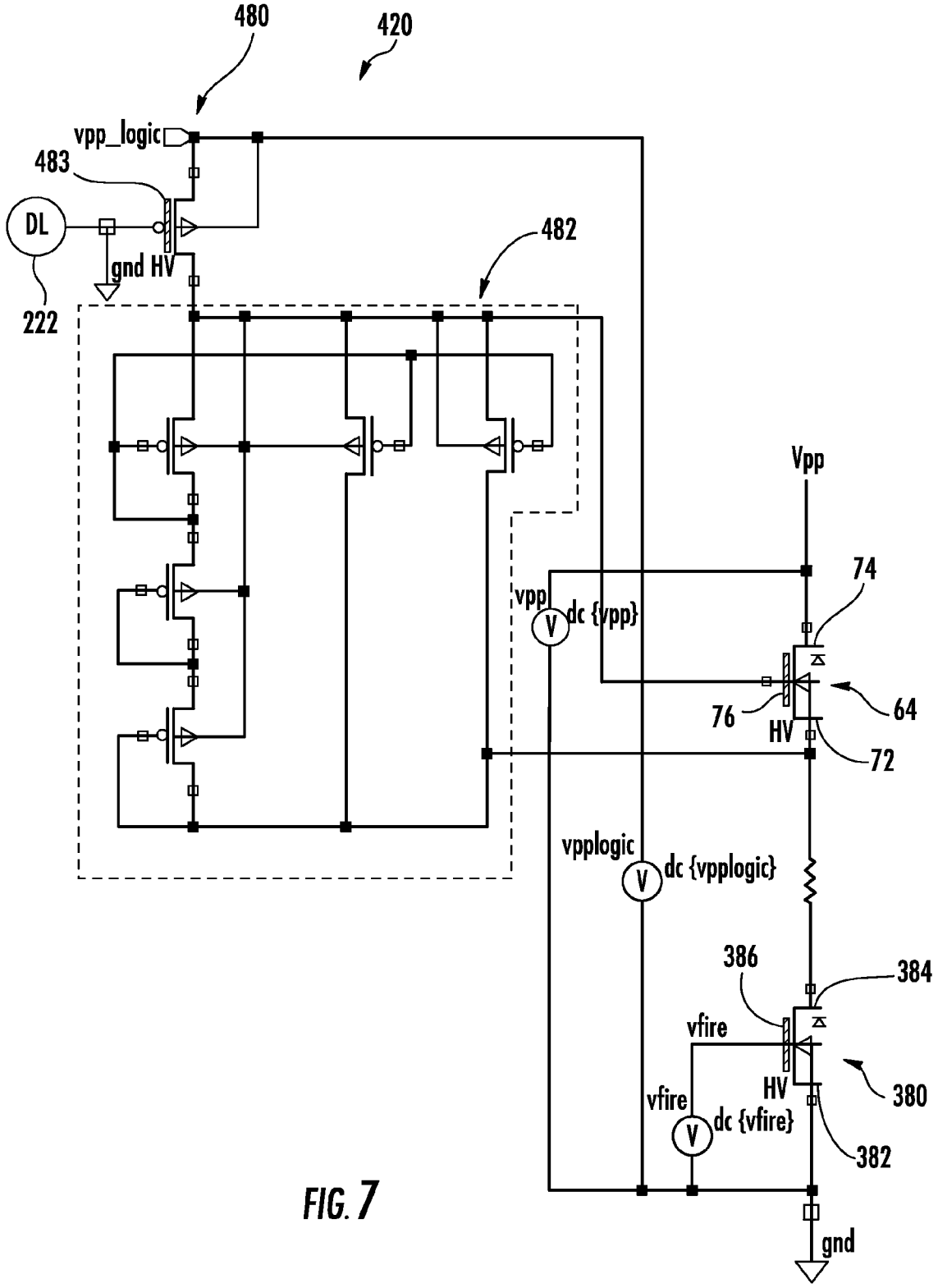
FIG. 7 is a circuit diagram of another example of the printing system of FIG. 1 including another example of an inkjet firing actuator power supply system.

FIG. 7 the circuit diagram of printing system 420, an example of printing system 20 shown in FIG. 1. Printing system 420 is similar to printing system 320 except that printing system 420 is additionally illustrated as including an example level shifter 480 and an example clamping circuit 482. Level shifter 480 is similar to level shifter 280 described above. Level shifter 480 serves as switching mechanisms by which digital logic 222 of controller 38 (shown in FIG. 6) selectively applies a gate voltage to gate 76 of each transistor 64 when one of the actuators 54 sharing transistor 64 and its associated nozzle 52 are to be fired. In particular, in response to receiving a low voltage digital signal from digital logic 222, a level shifter 280 supplies gate 76 (and clamp circuit 482) with higher controlled or regulated voltage ($VPP_{logic}$) established by regulator 70. Because transistor 64 is in a source follower arrangement, the voltage seen at actuator 54 corresponds to the regulator controlled $VPP_{logic}$ provided at gate 76 in response to actuation or switching of level shifter 280. Note that in the arrangement shown in FIG. 7, the supply of the voltage to gate 76 upon actuation of level shifter 480 will not result in firing of the actuator 54 and nozzle 52 (shown in FIG. 6) until the LSS transistor 380 is actuated or turned on. Note further that although level shifter 480 is functionally represented with a single transistor 483, as a high-voltage PMOS device, in the example illustrated, level shifter 480 includes multiple high-voltage transistors, namely, two high voltage PMOS devices, two LDMOS transistors and digital CMOS gates.

Clamp circuit 482 is provided on die 244 for each HSS transistor 64. Each clamp circuit 282 comprises diode connected devices which turn on in response to the gate-to-source voltage becoming too high to limit the gate-source voltage as the voltage is pulled up to match the gate voltage (the voltage at gate 76) (minus some diode voltage drops). In other examples, clamp circuits 282 may have other configurations or may be omitted.

Because printing system 420 employs a LSS transistor 384 for each firing actuator 54 and associated nozzle 52, multiple nozzles 22 or primaries may share a single HSS transistor 64. As a result, the nozzles 22 of such primaries may also share a single level shifter 480 and a single clamping circuit 482. Consequently, additional cost and space are conserved.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a first nozzle;

a first firing actuator associated with the first nozzle; and a firing actuator power supply system comprising:

an internal power supply path;

a first high side switching (HSS) transistor in a source follower arrangement, the first HSS transistor having a drain electrically connected to the internal power supply path and a source electrically connected to a first end of the first firing actuator; and a voltage regulator having an input electrically connected to the internal power supply path and an output electrically connected to a gate of the first HSS transistor, the voltage regulator to provide the gate of the first HSS transistor with a controlled voltage no greater than a concurrent voltage at the drain.

2. The apparatus of claim 1 further comprising:

a second nozzle;

a second firing actuator associated with the second nozzle;

a second HSS transistor in a source follower arrangement, the second HSS transistor having a drain electrically connected to the internal power supply path and a source electrically connected to the second firing actuator, wherein the output of the voltage regulator is electrically connected to a gate of the second HSS transistor, the second regulator to provide the gate of the second transistor with a second controlled voltage no greater than a second concurrent voltage at the drain of the second HSS transistor.

3. The apparatus of claim 2 further comprising:

nozzle drive logic and circuitry; and a level shifter to electrically connect the output of the regulator to the gate of the first HSS transistor under control of the novel drive logic and circuitry.

4. The apparatus of claim 1 further comprising:

a nozzle drive logic and circuitry;

a first low supply side (LSS) transistor having a drain electrically connected to the first firing actuator, a source connected to ground and a gate electrically connected to the nozzle drive logic and circuitry.

5. The apparatus of claim 4 further comprising:

a second nozzle;

a second firing actuator associated with the second nozzle, the second firing actuator having a first end electrically connected to the source of the first HSS transistor; and a second LSS transistor having a drain electrically connected to a second end of the second firing actuator, a source connected to ground and a gate electrically connected to the nozzle drive logic and circuitry.

6. The apparatus of claim 5 further comprising:

a third nozzle;

a third firing actuator associated with the third nozzle;

a fourth nozzle;

a fourth firing actuator associated with the fourth nozzle;

a second HSS transistor in a source follower arrangement, the second HSS transistor having a drain electrically connected to the internal power supply path, a source electrically connected to a first end of the third firing actuator and a first end of the fourth firing actuator and a gate electrically connected to the output of the voltage regulator, the voltage regulator to provide the gate of the second HSS transistor with a controlled voltage no greater than a concurrent voltage at the drain of the second HSS transistor;

a third LSS transistor having a drain electrically connected to a second end of the third firing actuator, a source connected to ground and a gate electrically connected to the nozzle drive logic and circuitry; and a fourth LSS transistor having a drain electrically connected to a second end of the fourth firing actuator, a source connected to ground and a gate electrically connected to the nozzle drive logic and circuitry.

7. The apparatus of claim 6 further comprising a printhead die having a slot, wherein the first firing actuator and second firing actuator are at a first end of the slot and wherein the third firing actuator and the fourth firing actuator are at a second end of the slot opposite the first end.

8. The apparatus of claim 1 further comprising a clamp circuit having input electrically to the gate and a source of the first transistor, the clamp circuit to limit a voltage difference between the gate and the source of the first transistor.

9. The apparatus of claim 1 further comprising a printhead die carrying the first regulator.

10. The apparatus of claim 1, wherein the first transistor comprises a power field effect transistor.

11. The apparatus of claim 1, wherein the controlled voltage provided by the regulator comprises an output voltage less than a minimum system power supply voltage under maximum load.

12. The apparatus of claim 1, wherein the first regulator comprises:

a linear regulator providing the input and the output of the voltage regulator; and feedback resistors connected to the linear regulator and configured to produce an output voltage less than a minimum system supply voltage under maximum load.

13. A power supply system for a liquid firing actuator, the power supply system comprising:

an internal power supply path;

a high side switching (HSS) transistor in a source follower arrangement, the HSS transistor comprising a power field effect transistor having a drain electrically connected to the internal power supply path and a source to be electrically connected to an end of the liquid firing actuator; and a voltage regulator having an input electrically connected to the internal power supply path and an output electrically connected to a gate of the HSS transistor, the voltage regulator to produce an output voltage less than a minimum system supply voltage under maximum load.

* * * * *